US010322588B2

(12) United States Patent
Hamada

(10) Patent No.: US 10,322,588 B2
(45) Date of Patent: Jun. 18, 2019

(54) LIQUID DISCHARGING APPARATUS AND IMAGE FORMING METHOD

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/598,551

(22) Filed: May 18, 2017

(65) Prior Publication Data

US 2017/0334213 A1 Nov. 23, 2017

(30) Foreign Application Priority Data

May 23, 2016 (JP) ..... 2016-102524

(51) Int. Cl.
*B41J 2/21* (2006.01)

(52) U.S. Cl.
CPC ..... *B41J 2/2103* (2013.01); *B41J 2/2117* (2013.01)

(58) Field of Classification Search
None
See application file for complete search history.

(56) References Cited

U.S. PATENT DOCUMENTS

2007/0030323 A1* 2/2007 Snyder ..... B41J 2/0057 347/89
2009/0244568 A1 10/2009 Watanabe

FOREIGN PATENT DOCUMENTS

| | | |
|---|---|---|
| JP | 2009-241419 | 10/2009 |
| JP | 2011-062946 | 3/2011 |
| JP | 2011-152737 | 8/2011 |
| JP | 2013-154515 | 8/2013 |

* cited by examiner

*Primary Examiner* — Matthew Luu
*Assistant Examiner* — Tracey M McMillion
(74) *Attorney, Agent, or Firm* — Workman Nydegger

(57) ABSTRACT

A liquid discharging apparatus includes a support unit configured to support a medium, a discharging unit configured to discharge a liquid onto the medium supported by the support unit, and a controller capable of executing a first image formation operation that forms a first image by causing the discharging unit to discharge liquid on the medium, and a second image formation operation that forms a second image by causing the discharging unit to discharge liquid onto the medium on which the first image is formed. In the case where a same-color region having the same color as the first image located under the second image is present in the second image in a region overlapping with the first image, the controller causes the same-color region to be formed in both the first image formation operation and the second image formation operation.

10 Claims, 7 Drawing Sheets

LIQUID DISCHARGING APPARATUS AND IMAGE FORMING METHOD

BACKGROUND

1. Technical Field

The present invention relates to a liquid discharging apparatus and an image forming method.

2. Related Art

Liquid discharging apparatuses that form an image on a medium by discharging a liquid have been in use for some time. Among such liquid discharging apparatuses, liquid discharging apparatuses are used that form a ground layer (a first image) using a ink for ground and then form a desired image (a second image) over the first image using color ink.

For example, JP-A-2011-62946 discloses a technique in which white ink is discharged onto a medium as a first image (white printing), and then a second image is formed over the first image using color ink (color printing).

In liquid discharging apparatuses of the related art, which form a first image and a second image in an overlapping manner, the second image is formed after forming the first image. The ink, meanwhile, is divided into first image ink and second image ink. Only the first image ink is used when forming the first image, and only the second image ink is used when forming the second image. In the case where the region of the second image that overlaps with the first image contains a same-color region having the same color as the first image located under the second image (that is, in the case where the image formed as the second image has a part that is the same color as the first image), the color of the first image located under the second image is sometimes used as-is.

However, in the case where the first image and the second image are formed in an overlapping manner, problems such as the following arise. For example, if the concentration of the white ink is low in the same-color region, an increased amount of white ink is discharged in order to increase that concentration. However, doing so causes the white ink to spill over and run on the medium. The operations for forming the first image can be divided into multiple stages to keep the white ink from spilling over, but doing so causes the operations to take more time.

SUMMARY

An advantage of some aspects of the invention is to form images correctly in the case where a first image and a second image are formed in an overlapping manner. To solve the aforementioned problems, according to a first aspect of the invention, a liquid discharging apparatus includes: a support unit configured to support a medium; a discharging unit configured to discharge a liquid onto the medium supported by the support unit; and a controller capable of executing a first image formation operation that forms a first image by causing the discharging unit to discharge a liquid on the medium, and a second image formation operation that forms a second image by causing the discharging unit to discharge a liquid onto the medium on which the first image is formed. In a case where a same-color region having the same color as the first image located under the second image is present in the second image in a region overlapping with the first image, the controller causes the same-color region to be formed in both the first image formation operation and the second image formation operation.

According to this aspect, in the case where the same-color region having the same color as the first image located under the second image is present in a region of the second image that overlaps with the first image, the same-color region is formed in both the first image formation operation and the second image formation operation. Accordingly, the concentration in the image can be increased in the same-color region, and the second image formation operation can be executed after the image from the first image formation operation has dried. This makes it possible to ensure the liquid in the same-color region does not spill over, and because this eliminates the need for dividing the first image formation operation into multiple stages, the time required can be shortened as well. Accordingly, when a first image and a second image are formed in an overlapping manner, the images can be formed correctly.

Note that "increasing the concentration" means increasing the amount of liquid discharged (increasing the density of the liquid per unit of surface area on the medium).

According to a second aspect of the invention, in the liquid discharging apparatus according to the first aspect, the controller sets an amount of liquid discharged to form the same-color region in the first image formation operation to be greater than an amount of liquid discharged to form the same-color region in the second image formation operation.

According to this aspect, the amount of liquid discharged to form the same-color region in the first image formation operation is set to be greater than the amount of liquid discharged to form the same-color region in the second image formation operation. Accordingly, a large amount of the liquid can be effectively dried in the time from after the first image formation operation has been executed to before the second image formation operation is executed, which makes it possible to effectively suppress running in the image in the same-color region.

According to a third aspect of the invention, in the liquid discharging apparatus according to the first aspect, the controller sets an amount of liquid discharged to form the same-color region in the second image formation operation to be greater than an amount of liquid discharged to form the same-color region in the first image formation operation.

According to this aspect, the amount of liquid discharged to form the same-color region in the second image formation operation is set to be greater than the amount of liquid discharged to form the same-color region in the first image formation operation. Accordingly, running in the image (the liquid) in the same-color region resulting from the first image formation operation can be suppressed, and a situation in which the second image formation operation forms an image in the same-color region in which the liquid is running can be suppressed.

According to a fourth aspect of the invention, in the liquid discharging apparatus according to any one of the first to third aspects, the controller sets a size of an image that forms the same-color region in the second image formation operation to be smaller than a size of an image that forms the same-color region in the first image formation operation.

According to this aspect, the size of the image that forms the same-color region in the second image formation operation is set to be smaller than the size of the image that forms the same-color region in the first image formation operation. Accordingly, a situation in which the liquid being discharged in the second image formation operation causes different colors of liquid to mix and bleed between the same-color region and a region adjacent thereto can be suppressed.

According to a fifth aspect of the invention, in the liquid discharging apparatus according to any one of the first to fourth aspects, the first image is a white image formed using white ink, the second image is a color image formed using white ink and color ink of a color that is not white, and the same-color region is formed of white ink.

According to this aspect, the first image is a white image formed using white ink, the second image is a color image formed using white ink and color ink of a color that is not white, and the same-color region is formed of white ink. In other words, the same-color region is formed by using white ink in both the first image formation operation and the second image formation operation. Accordingly, a ground layer can be formed using white ink, and the same-color region can be formed densely without any running.

According to a sixth aspect of the invention, in the liquid discharging apparatus according to the fifth aspect, the white ink that forms the same-color region differs between a first white ink used in the first image formation operation and a second white ink used in the second image formation operation.

According to this aspect, the white ink that forms the same-color region differs between a first white ink used in the first image formation operation and a second white ink used in the second image formation operation. Accordingly, the discharge conditions can be varied between the first image formation operation and the second image formation operation, and the composition of the ink can also be varied in accordance with the discharge conditions in the first image formation operation and the second image formation operation.

According to a seventh aspect of the invention, in the liquid discharging apparatus according to the sixth aspect, a difference between discharge characteristics of the second white ink and the color ink is smaller than a difference between discharge characteristics of the first white ink and the color ink.

According to this aspect, the difference between discharge characteristics of the second white ink and the color ink is smaller than the difference between discharge characteristics of the first white ink and the color ink. This allows the second white ink and the color ink to be discharged under the same discharge conditions in the second image formation operation, which simplifies the control of the discharging unit.

The "difference between the discharge characteristics of the white ink and the color ink" means, for example, a difference in discharge states in the case where the white ink and the color ink are discharged using the same applied voltage and the same discharge frequency. This corresponds to a specific difference in the inks, such as a difference in physical properties (viscosity, surface tension, and the like). As a result, this aspect corresponds to the case where a difference between the physical properties of the second white ink and the color ink is smaller than a difference between the physical properties of the first white ink and the color ink.

An image forming method according to an eighth aspect of the invention is an image forming method executed by a liquid discharging apparatus including a support unit configured to support a medium and a discharging unit configured to discharge a liquid onto the medium supported by the support unit. The method includes: forming a same-color region in both a first image formation operation and a second image formation operation, in a case where the first image formation operation that forms a first image by causing the discharging unit to discharge a liquid on the medium, and the second image formation operation that forms a second image by causing the discharging unit to discharge a liquid onto the medium on which the first image is formed, and the same-color region having the same color as the first image located under the second image is present in the second image in a region overlapping with the first image.

According to this aspect, in the case where the same-color region having the same color as the first image located under the second image is present in a region of the second image that overlaps with the first image, the same-color region is formed in both the first image formation operation and the second image formation operation. Accordingly, the concentration in the image can be increased in the same-color region, and the second image formation operation can be executed after the image from the first image formation operation has dried. This makes it possible to ensure the liquid in the same-color region does not spill over, and because this eliminates the need for dividing the first image formation operation into multiple stages, the time required can be shortened as well. Accordingly, when a first image and a second image are formed in an overlapping manner, the images can be formed correctly.

BRIEF DESCRIPTION OF THE DRAWINGS

The invention will be described with reference to the accompanying drawings, wherein like numbers reference like elements.

DESCRIPTION OF EMBODIMENTS

Hereinafter, a printing apparatus 1 embodying the liquid discharging apparatus according to an aspect of the invention will be described in detail with reference to the appended drawings.

Figure 1:
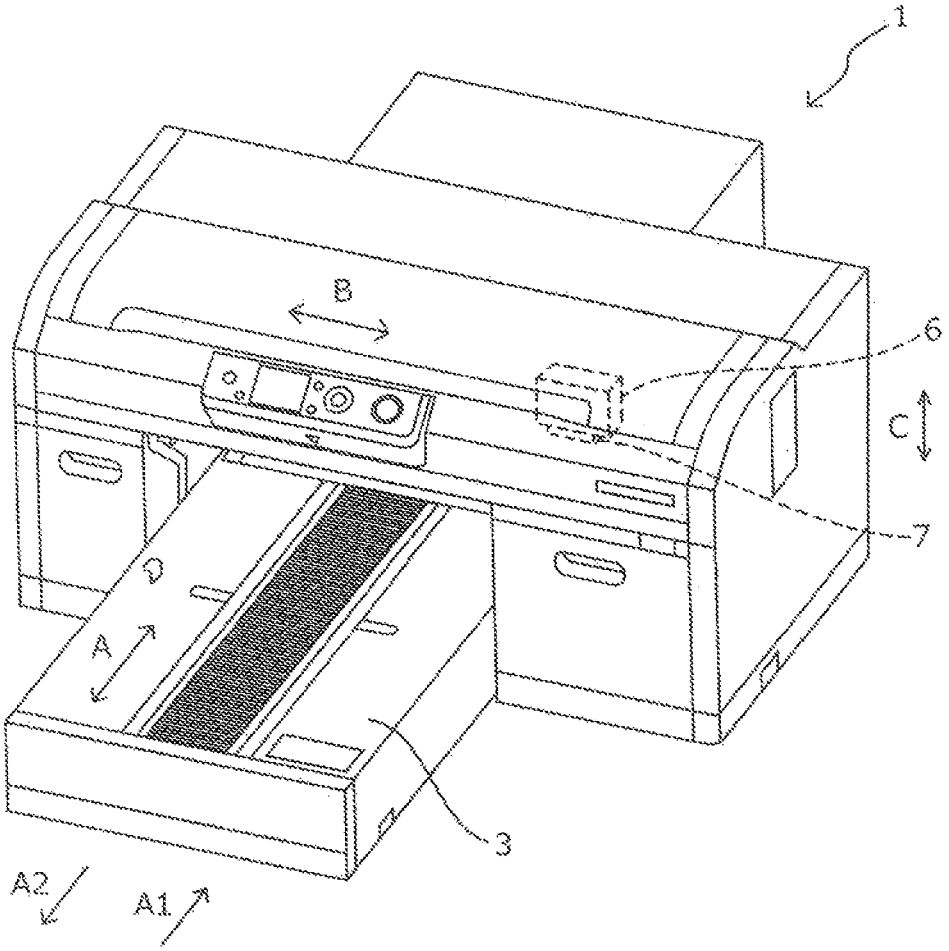
FIG. 1 is an overall perspective view of a printing apparatus according to an embodiment of the invention.
Figure 2:
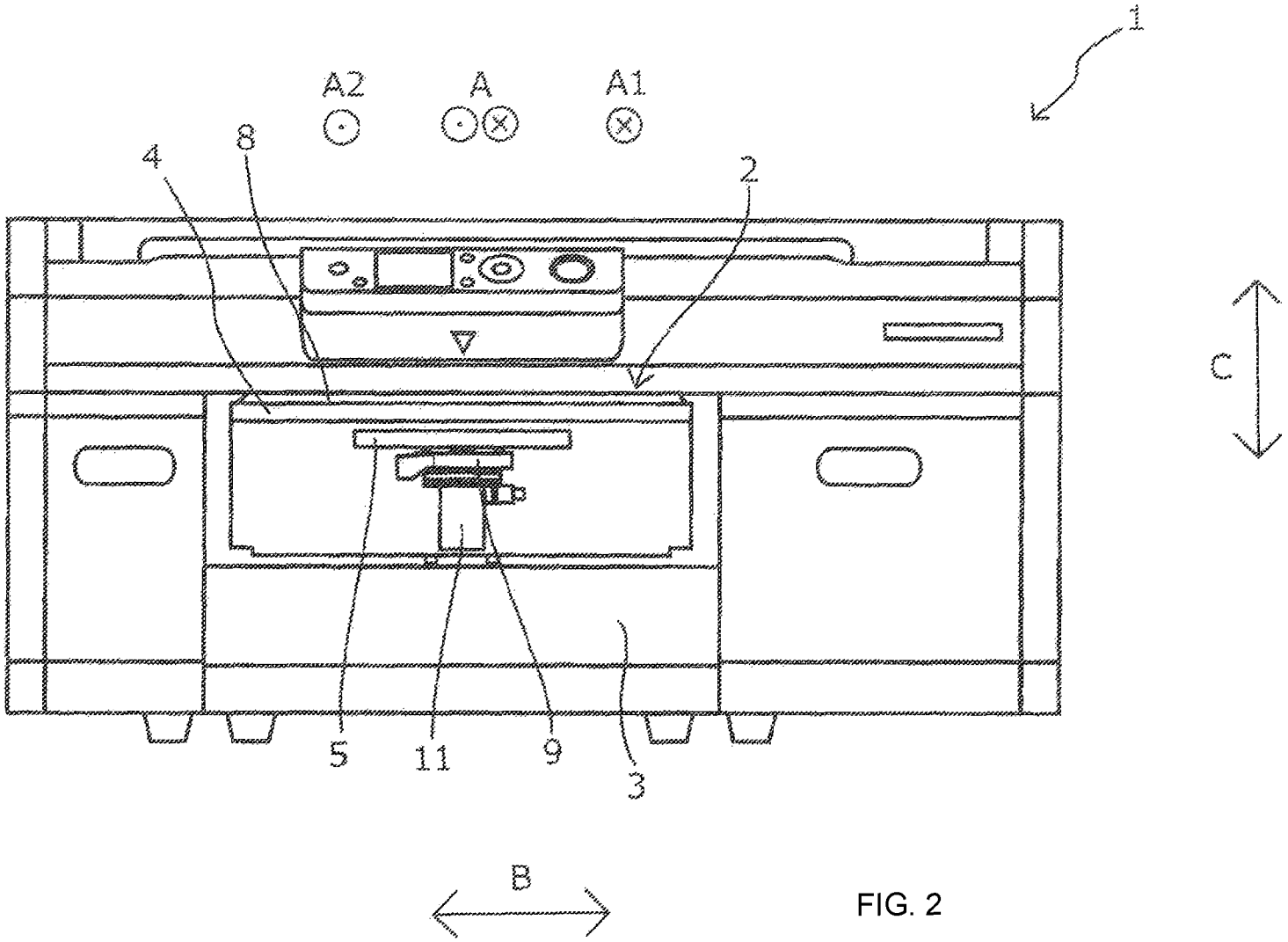
FIG. 2 is an overall front view of a printing apparatus according to an embodiment of the invention.
Figure 3:
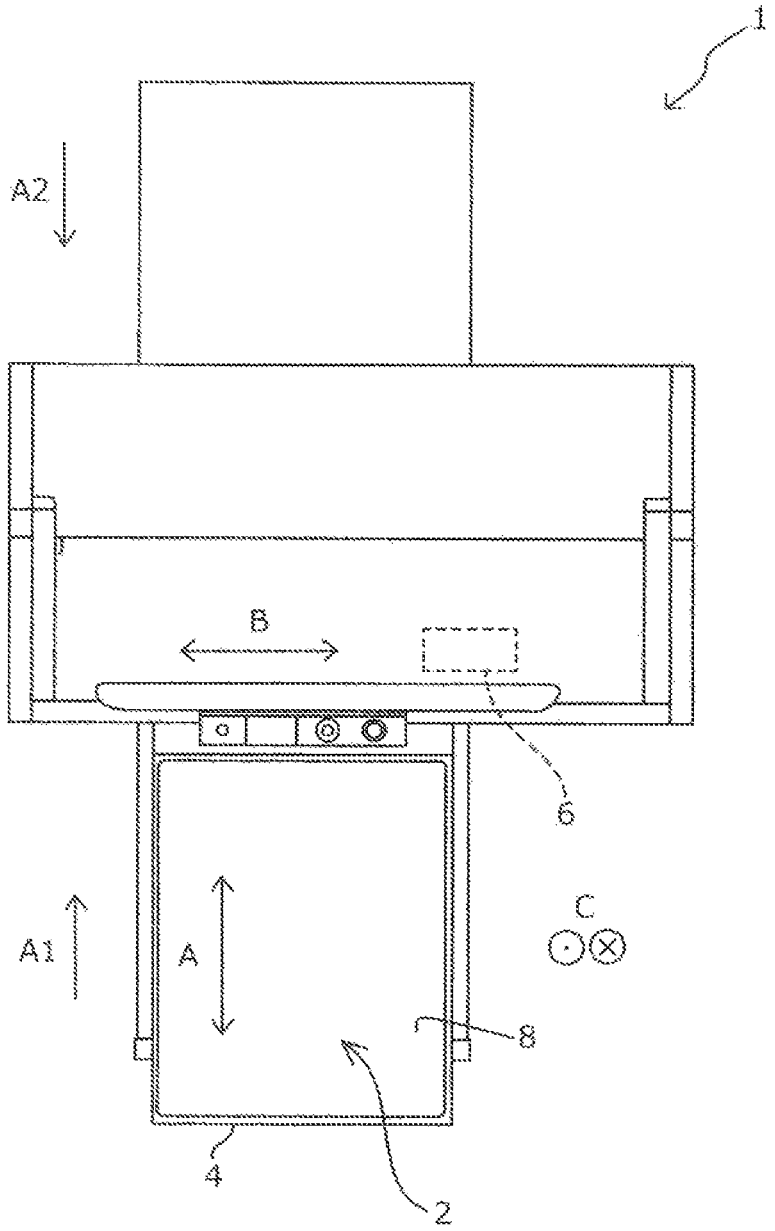
FIG. 3 is an overall plan view of a printing apparatus according to an embodiment of the invention.

FIG. 1 is an overall perspective view of the printing apparatus 1 according to the present embodiment, and illustrates a state in which a medium support unit 2 is in a printing start position. FIG. 2 is an overall front view of the printing apparatus 1 according to the embodiment. FIG. 3 is an overall plan view of the printing apparatus 1 according to the embodiment, and illustrates a state in which the medium support unit 2 is in a medium setting position. Note that FIG. 1 to FIG. 3 illustrate some constituent elements in a simplified manner.

The printing apparatus 1 according to the embodiment includes the medium support unit 2, which moves in a movement direction A while supporting a medium on a support surface 8 of a tray 4 serving as a support unit.

The printing apparatus 1 also includes a medium transport unit 3 that transports the medium supported by the tray 4 in the movement direction A. The movement direction A is a direction including a direction A1, and a direction A2 opposite from the direction A1.

The medium support unit 2 is removably installed on a stage 5. Here, a removal/attachment direction C, in which the medium support unit 2 is attached to/removed from the stage 5, corresponds to the vertical direction for the printing apparatus 1 according to the embodiment. Rotating a lever 9 causes the medium support unit 2 to move in the removal/attachment direction C (in the vertical direction) along with the stage 5. As illustrated in FIG. 2, the lever 9 is provided on an arm unit 11. A variety of materials can be used as the medium, including textiles (fabric, cloth, and the like), paper, vinyl chloride resin, and the like.

Additionally, although the printing apparatus 1 according to the embodiment includes the support unit that moves in the movement direction A while supporting the medium, the apparatus is not limited to this configuration. For example, the configuration may be such that the medium is transported by causing the medium to slide along a support surface of a fixed support unit while being supported by that support unit.

The printing apparatus 1 includes, in its interior, a print head 7 serving as a discharging unit capable of printing onto a medium by discharging ink, which is an example of a liquid. The printing apparatus 1 according to the embodiment moves a carriage 6 on which the print head 7 is provided back and forth in a scanning direction B, which intersects with the movement direction A. The printing apparatus 1 forms a desired image by discharging ink from the print head 7 onto a medium supported by the tray 4 while moving the print head 7 back and forth in the scanning direction B.

Note that in the printing apparatus 1 according to the embodiment, the front side (the lower-left) in FIG. 1 corresponds to the setting position for setting the medium on the tray 4 (see FIG. 3). The tray 4 on which the medium is set is moved in the direction A1 in the movement direction A until the tray 4 reaches the printing start position, which corresponds to the rear side (the upper-right) in FIG. 1. The printing is then carried out while the tray 4 is moved in the direction A2 in the movement direction A.

The printing apparatus 1 according to the embodiment is configured such that the print head 7 can discharge white ink and color ink (black ink, yellow ink, cyan ink, and magenta ink). The tray 4 is moved from the setting position to the printing start position, whereupon a first image formation operation is executed by forming a first image, serving as a ground layer, using white ink while the tray 4 is moved in the direction A2. Then, the tray 4 is again moved to the printing start position, whereupon a second image formation operation is executed by forming a second image, serving as a desired image, using color ink (depending on the image, white ink may also be used) while the tray 4 is moved in the direction A2. An image forming method using the printing apparatus 1 according to the embodiment will be described in detail later.

Although the printing apparatus 1 according to the embodiment is configured such that the print head 7 can discharge white ink and color ink, the apparatus is not limited to such a configuration. For example, metallic ink may be used instead of white ink. In other words, the configuration may be such that the first image is formed using metallic ink, and the second image is formed using color ink (black ink, yellow ink, cyan ink, and magenta ink) and, depending on the image, metallic ink as well. Furthermore, colors aside from those mentioned above (light cyan ink, light magenta ink, orange ink, green ink, and blue ink, for example) may be used as the color ink.

The printing apparatus 1 according to the embodiment includes the print head 7, which prints while moving back and forth in the scanning direction B, as the discharging unit. However, the printing apparatus may instead include what is known as a line head, in which a plurality of nozzles that discharge ink are provided in an intersecting direction that intersects with the movement direction.

Here, a "line head" is a print head provided such that a region including the nozzles formed in the intersecting direction that intersects with the movement direction of the medium is capable of covering the entirety of that intersecting direction, and is used in a printing apparatus that forms an image by moving the print head or the medium relative to each other. However, in the line head, the region including the nozzles in the intersecting direction needs not be capable of covering the intersecting direction for all types, sizes, and the like of media that can be used in the printing apparatus.

The electrical configuration of the printing apparatus 1 according to the embodiment will be described next.

Figure 4:
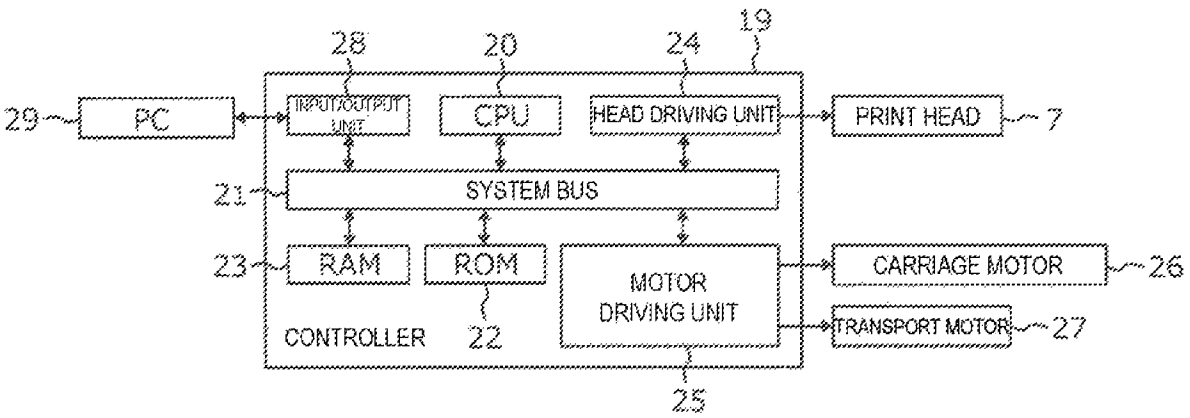
FIG. 4 is a block diagram illustrating a printing apparatus according to an embodiment of the invention.

FIG. 4 is a block diagram illustrating the printing apparatus 1 according to the embodiment.

A CPU 20 that controls the printing apparatus 1 as a whole is provided in a controller 19. The CPU 20 is connected, via a system bus 21, to ROM 22, in which various control programs and the like executed by the CPU 20 are stored, and RAM 23, in which the CPU 20 can store data temporarily.

The CPU 20 is also connected, via the system bus 21, to a head driving unit 24 for driving the print head 7.

The CPU 20 is furthermore connected, via the system bus 21, to a motor driving unit 25. The motor driving unit 25 is connected to a carriage motor 26 for moving the carriage 6 on which the print head 7 is provided, and a transport motor 27 provided in the medium transport unit 3 for transporting the medium (in other words, for moving the medium support unit 2).

The CPU 20 is furthermore connected, via the system bus 21, to an input/output unit 28. The input/output unit 28 is connected to a PC 29 for sending and receiving data such as print data and signals.

Being configured as such, the controller 19 controls the printing apparatus 1 as a whole and causes the printing apparatus 1 to execute an image forming method (described below).

An image forming method using the printing apparatus 1 according to the embodiment will be described next.

Figure 5:
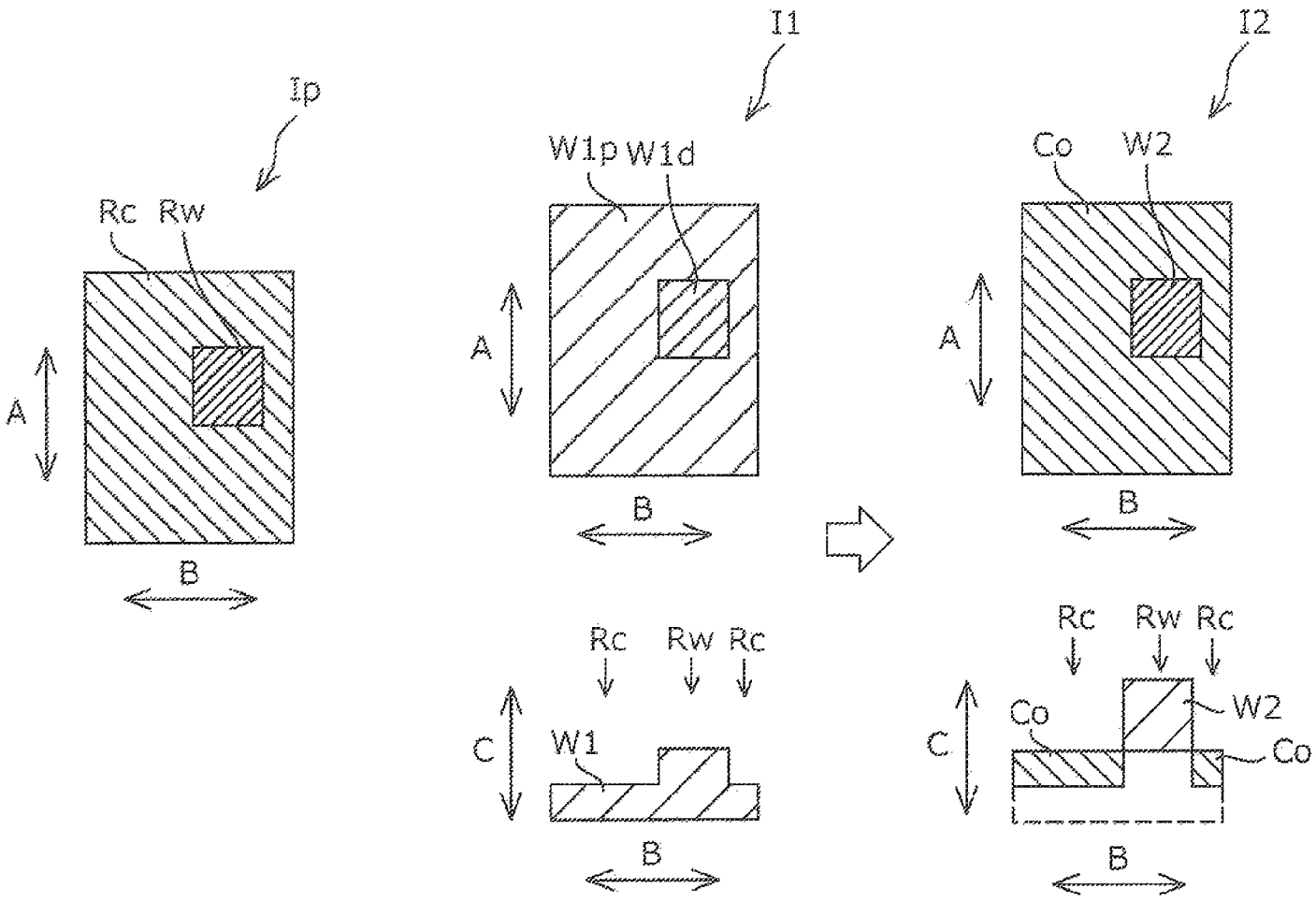
FIG. 5 is a diagram illustrating an image forming method that can be executed using a printing apparatus according to an embodiment of the invention.
Figure 7:
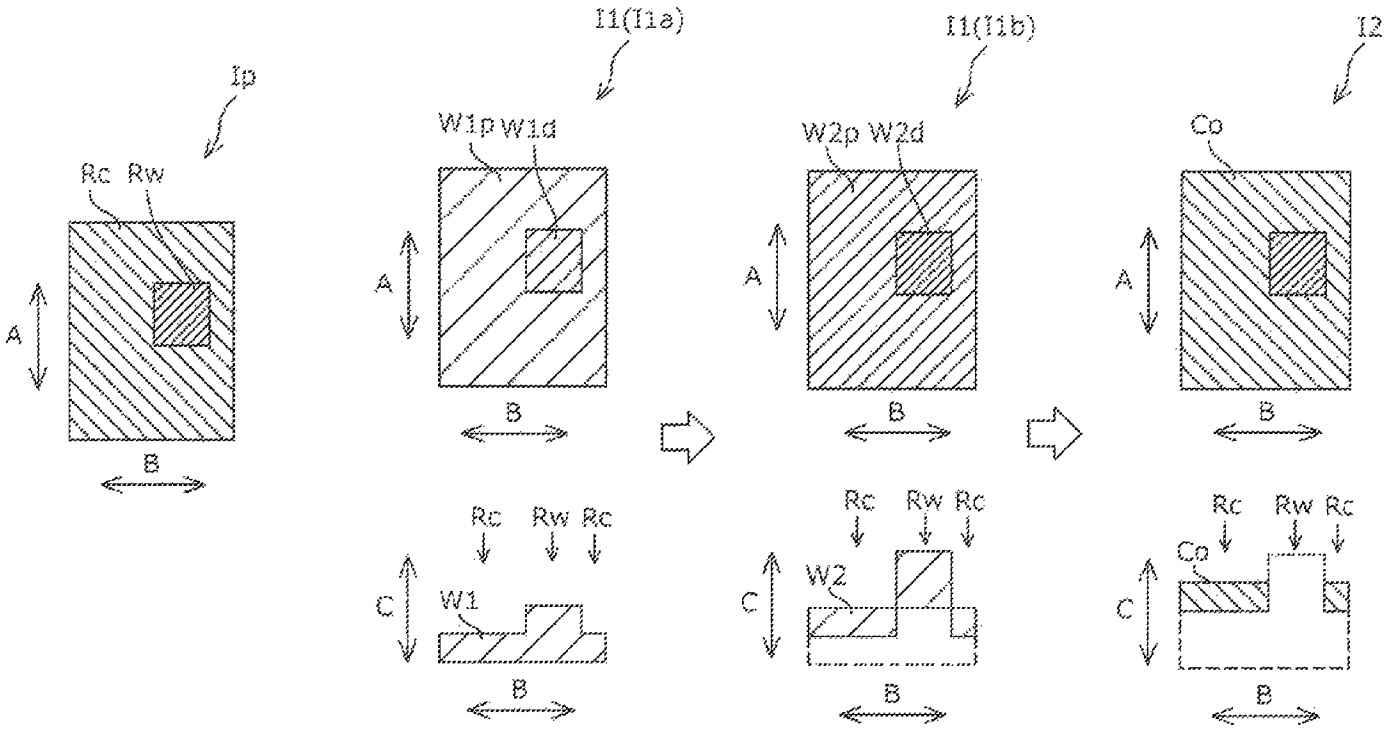
FIG. 7 is a diagram illustrating an image forming method that can be executed using a printing apparatus of the related art.

FIG. 5 is a diagram illustrating an image forming method that can be executed using the printing apparatus 1 according to the embodiment. FIG. 7, meanwhile, is a diagram illustrating an image forming method that can be executed using a printing apparatus of the related art. In FIG. 5 and FIG. 7, an image Ip represents an image desired by a user (an image following the formation of the second image), an image I1 represents the image following the formation of the first image, and an image I2 represents the image following the formation of the second image. In the depictions of the images I1 and I2, the upper sections are conceptual diagrams illustrating the images from above, and the lower sections are conceptual diagrams illustrating the images from the side. FIG. 5 and FIG. 7 illustrate examples in which the image Ip is an image having a region Rc expressing colors using color ink (black ink, yellow ink, cyan ink, and magenta ink), and a region Rw expressing colors by making use of the white ink color (that is to say, a same-color region, which is a region of the second image that overlaps with the first image and has the same color as the first image located under the second image).

In FIG. 5 and FIG. 7, the upper sections in the illustrations of the images I1 and I2 indicate the ink furthest on the surface side with diagonal lines, whereas the lower sections in the illustrations of the images I1 and I2 indicate the ink discharged in the corresponding image forming operations with diagonal lines.

An image forming method that can be executed using a printing apparatus of the related art will be described first.

As illustrated in FIG. 7, in the case where the image Ip is to be formed using the printing apparatus of the related art, the first image formation operation is first executed in order to form the image I1 (an image I1*a*). Here, the region Rw expresses a color by making use of the white ink color, and it is thus necessary to increase the concentration of the white ink. Thus, as indicated in the lower section of the illustration of the image I1*a*, the amount of white ink discharged in the region Rw (the density of the ink per unit of surface area on the medium) is greater than the amount of white ink discharged in the region Rc. However, if too much ink is discharged in a single first image formation operation, the ink will spill over. To bring the region Rw to the desired concentration while ensuring the ink does not spill over, the first image formation operation is split into two operations. Specifically, a first image formation operation for forming an image I1*b* is carried out after the first image formation operation for forming the image I1*a*. In this example, the first image formation operation for forming the image I1*a* and the first image formation operation for forming the image I1*b* are exactly the same operation. In other words, the amount of white ink discharged in the region Rc is the same for white ink W1*p*, which forms the region Rc in the image I1*a*, and for white ink W2*p*, which forms the region Rc in the image I1*b*. Additionally, the amount of white ink discharged in the region Rw is the same for white ink W1*d*, which forms the region Rw in the image I1*a*, and for white ink W2*d*, which forms the region Rw in the image I1*b*. The white ink discharged in the first image forming operation is white ink W1 (of this, the white ink discharged in the region Rc is the white ink W1*p*, and the white ink discharged in the region Rw is the white ink W1*d*). The white ink discharged in the second image forming operation is white ink W2 (of this, the white ink discharged in the region Rc is the white ink W2*p*, and the white ink discharged in the region Rw is the white ink W2*d*).

After the first image formation operation is complete, the second image formation operation is executed to form the image I2. As is clear from the image I2, with the printing apparatus of the related art, only color ink Co is discharged in the second image formation operation.

Note that if the second image formation operation is executed after the first image formation operation for forming the image I1*a*, the white ink in the region Rw will have a concentration lower than a desired concentration.

An image forming method that can be executed using the printing apparatus 1 according to the embodiment will be described next.

As illustrated in FIG. 5, in the case where the image Ip is to be formed using the printing apparatus 1 according to the embodiment, the first image formation operation is first executed in order to form the image I1. Note that the image I1 in FIG. 5 is exactly the same as the image I1*a* in FIG. 7.

After the first image formation operation is complete, the second image formation operation is executed to form the image I2. As is clear from the image I2, with the printing apparatus 1 according to the embodiment, both the color ink Co and the white ink W2 are discharged in the second image formation operation.

When forming the image Ip using the printing apparatus of the related art, it is necessary to carry out the image forming operations in three stages, as illustrated in FIG. 7, in order to bring the region Rw to the desired concentration while ensuring the ink in the region Rw does not spill over.

However, when forming the image Ip using the printing apparatus 1 according to the embodiment, only two stages are required for the image forming operations, as illustrated in FIG. 5. This makes it possible to shorten the printing time.

To summarize the above descriptions, the printing apparatus 1 according to the embodiment includes the tray 4, which supports the medium, and the print head 7, which discharges ink onto the medium supported by the tray 4. The controller 19 is capable of executing a first image formation operation, which forms a first image by causing ink to be discharged from the print head 7, and a second image formation operation, which forms a second image by causing ink to be discharged from the print head 7 onto the medium on which the first image has been formed.

In the case where a region Rw having the same color as the first image located under the second image is present in a region of the second image that overlaps with the first image, the controller 19 forms the region Rw in both the first image formation operation and the second image formation operation. Accordingly, the concentration in the image can be increased in the same-color region, and the second image formation operation can be executed after the image from the first image formation operation has dried. This makes it possible to ensure the ink in the region Rw does not spill over, and because this eliminates the need for dividing the first image formation operation into multiple stages, the time required can be shortened as well. Accordingly, when a first image and a second image are formed in an overlapping manner, the images can be formed correctly.

Note that "increasing the concentration" means increasing the amount of ink discharged (increasing the density of the ink per unit of surface area on the medium).

Additionally, the controller 19 according to the embodiment can set the amount of the white ink W1 discharged in order to form the region Rw in the first image formation operation to be greater than the amount of the white ink W2 discharged in order to form the region Rw in the second image formation operation. Accordingly, a large amount of the white ink can be effectively dried in the time from after the first image formation operation has been executed to before the second image formation operation is executed, which makes it possible to effectively suppress running in the image in the region Rw.

On the other hand, the controller 19 according to the embodiment can set the amount of the white ink W2 discharged in order to form the region Rw in the second image formation operation to be greater than the amount of the white ink W1 discharged in order to form the region Rw in the first image formation operation. Accordingly, running in the image (the white ink W1) in the region Rw resulting from the first image formation operation can be suppressed, and a situation in which the second image formation operation forms an image in the region Rw in which the white ink W1 is running can be suppressed.

Furthermore, the controller 19 according to the embodiment can set the size of the image that forms the region Rw in the second image formation operation to be smaller than the size of the image that forms the region Rw in the first image formation operation. Accordingly, a situation in which the ink being discharged in the second image formation operation causes different colors of ink to mix and bleed between the region Rw and a region adjacent thereto can be suppressed.

As described above, the printing apparatus 1 according to the embodiment includes both white ink and color ink.

In FIG. 5, the image I1, which serves as the first image, is a white image formed using white ink, whereas the image I2, which serves as the second image, is a color image formed using white ink and color ink of a color that is not white. Furthermore, as indicated by the image I2 in FIG. 5, the region Rw is formed using white ink.

In other words, the region Rw is formed by using white ink in both the first image formation operation and the second image formation operation. Accordingly, the printing apparatus 1 according to the embodiment can form the ground layer using white ink, and can form the region Rw densely without any running.

However, as described above, other ink such as metallic ink or color ink may be used instead of white ink when forming the first image. Even in the case where the first image is formed using ink that is not white ink, when there is a region in the second image that has the same color as the first image (a same-color region), the same-color region can be formed through the same procedure as in the embodiment.

The printing apparatus 1 according to the embodiment is configured such that only one type of white ink can be used.

However, the apparatus may be configured such that the white ink used to form the region Rw is different, that is, first white ink is used in the first image formation operation and second white ink is used in the second image formation operation. According to this configuration, the discharge conditions can be varied between the first image formation operation and the second image formation operation, and the composition of the ink can also be varied in accordance with the discharge conditions in the first image formation operation and the second image formation operation.

In the case of such a configuration, a difference between discharge characteristics of the second white ink and the color ink is preferably smaller than a difference between discharge characteristics of the first white ink and the color ink. This makes it possible for the second white ink and the color ink to be discharged under the same discharge conditions in the second image formation operation, which simplifies the control of the discharging unit.

The "difference between the discharge characteristics of the white ink and the color ink" means, for example, a difference in discharge states in the case where the white ink and the color ink are discharged using the same applied voltage and the same discharge frequency. This corresponds to a specific difference in the inks, such as a difference in physical properties (viscosity, surface tension, and the like). As a result, this configuration corresponds to the case where a difference between the physical properties of the second white ink and the color ink is smaller than a difference between the physical properties of the first white ink and the color ink.

The image forming method that can be executed using the printing apparatus 1 according to the embodiment will be described in further detail hereafter using a flowchart.

Figure 6:
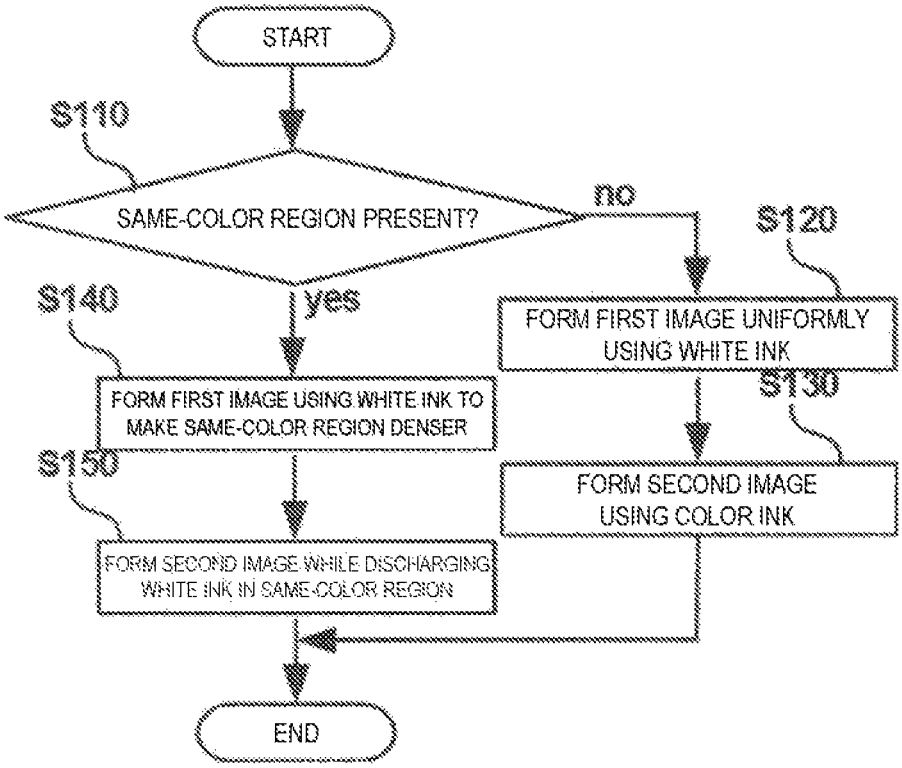
FIG. 6 is a flowchart illustrating an image forming method that can be executed using a printing apparatus according to an embodiment of the invention.

FIG. 6 is a flowchart illustrating the image forming method that can be executed using the printing apparatus 1 according to the embodiment.

Upon print data being inputted from the PC 29 and the image forming method according to the embodiment starting, first, in step S110, the controller 19 determines whether or not a same-color region (the region Rw) is present in the image to be printed. In the embodiment, the first image is white. As such, specifically, whether or not the same-color region is present is determined by determining whether or not a white region is present in the print data corresponding to the second image. The process moves to step S120 in the case where the controller 19 determines that there is no same-color region in step S110, and moves to step S140 in the case where the controller 19 determines that there is a same-color region in step S110.

In step S120, the first image is formed uniformly using white ink as the first image formation operation, after which the process moves to step S130.

Then, in step S130, the second image is formed on the basis of the print data using color ink as the second image formation operation. When the formation of the second image is complete, the image forming method according to the embodiment ends.

On the other hand, in step S140, the first image is formed using white ink such that the region Rw is denser than the region Rc as the first image formation operation. The process then moves to step S150.

Then, in step S150, the second image is formed on the basis of the print data using color ink for the region Rc and white ink for the region Rw as the second image formation operation. When the formation of the second image is complete, the image forming method according to the embodiment ends.

Thus, the image forming method according to the embodiment is an image forming method carried out by the printing apparatus 1, which includes the tray 4 that supports the medium and the print head 7 that discharges ink onto the medium supported by the tray 4.

The first image formation operation, which forms a first image by causing ink to be discharged from the print head 7 (steps S120 and S140), and the second image formation operation, which forms a second image by causing ink to be discharged from the print head 7 onto the medium on which the first image has been formed (steps S130 and S150), are executed. At this time, in the case where a region Rw having the same color as the first image located under the second image is present in a region of the second image that overlaps with the first image (the case where the process moves from step S110 to step S140), the region Rw is formed through both the first image formation operation (step S140) and the second image formation operation (step S150).

Accordingly, the concentration in the image can be increased in the region Rw, and the second image formation operation can be executed after the image from the first image formation operation has dried. This makes it possible to ensure the ink in the region Rw does not spill over, and because this eliminates the need for dividing the first image formation operation into multiple stages, the time required can be shortened as well. Accordingly, when a first image and a second image are formed in an overlapping manner, the images can be formed correctly.

Note that the invention is not intended to be limited to the aforementioned embodiment, and many variations are possible within the scope of the invention as disclosed in the appended claims. It goes without saying that such variations also fall within the scope of the invention.

This application claims priority under 35 U.S.C. § 119 to Japanese Patent Application No. 2016-102524, filed May 23

2016. The entire disclosure of Japanese Patent Application No. 2016-102524 is hereby incorporated herein by reference.

What is claimed is:

1. A liquid discharging apparatus comprising:

a support unit configured to support a medium;

a discharging unit configured to discharge a liquid onto the medium supported by the support unit; and a controller capable of executing a first image formation operation that forms a first image by causing the discharging unit to discharge a liquid on the medium, and a second image formation operation that forms a second image by causing the discharging unit to discharge a liquid onto the medium on which the first image is formed, wherein in a case where a same-color region having the same color as the first image located under the second image is present in the second image in a region overlapping with the first image, the controller causes the same-color region to be formed in both the first image formation operation and the second image formation operation, wherein the first image is a white image formed using white ink;

the second image is a color image formed using white ink and color ink of a color that is not white; and the same-color region is formed of white ink.

2. The liquid discharging apparatus according to claim 1, wherein the controller sets an amount of liquid discharged to form the same-color region in the first image formation operation to be greater than an amount of liquid discharged to form the same-color region in the second image formation operation.

3. The liquid discharging apparatus according to claim 2, wherein the controller sets a size of an image that forms the same-color region in the second image formation operation to be smaller than a size of an image that forms the same-color region in the first image formation operation.

4. The liquid discharging apparatus according to claim 1, wherein the controller sets an amount of liquid discharged to form the same-color region in the second image formation operation to be greater than an amount of liquid discharged to form the same-color region in the first image formation operation.

5. The liquid discharging apparatus according to claim 4, wherein the controller sets a size of an image that forms the same-color region in the second image formation operation to be smaller than a size of an image that forms the same-color region in the first image formation operation.

6. The liquid discharging apparatus according to claim 1, wherein the controller sets a size of an image that forms the same-color region in the second image formation operation to be smaller than a size of an image that forms the same-color region in the first image formation operation.

7. The liquid discharging apparatus according to claim 5, wherein the white ink that forms the same-color region differs between a first white ink used in the first image formation operation and a second white ink used in the second image formation operation.

8. The liquid discharging apparatus according to claim 7, wherein a difference between discharge characteristics of the second white ink and the color ink is smaller than a difference between discharge characteristics of the first white ink and the color ink.

9. An image forming method executed by a liquid discharging apparatus including a support unit configured to support a medium and a discharging unit configured to discharge a liquid onto the medium supported by the support unit, the method comprising:

forming a same-color region in both a first image formation operation and a second image formation operation, in a case where the first image formation operation that forms a first image by causing the discharging unit to discharge a liquid on the medium, and the second image formation operation that forms a second image by causing the discharging unit to discharge a liquid onto the medium on which the first image is formed, are executed, and the same-color region having the same color as the first image located under the second image is present in the second image in a region overlapping with the first image, wherein the first image is a white image formed using white ink;

the second image is a color image formed using white ink and color ink of a color that is not white; and the same-color region is formed of white ink.

10. A liquid discharging apparatus comprising:

a support unit configured to support a medium;

a discharging unit configured to discharge a liquid onto the medium supported by the support unit; and a controller capable of executing a first image formation operation that forms a first image by causing the discharging unit to discharge a liquid on the medium, and a second image formation operation that forms a second image by causing the discharging unit to discharge a liquid onto the medium on which the first image is formed, wherein in a case where a same-color region having the same color as the first image located under the second image is present in the second image in a region overlapping with the first image, the controller causes the same-color region to be formed in both the first image formation operation and the second image formation operation, wherein the first image is a metallic image formed using metallic ink;

the second image is a color image formed using metallic ink and color ink of a color that is not metallic; and the same-color region is formed of metallic ink.

* * * * *